US006120258A

United States Patent [19]

Chen

[11] Patent Number: 6,120,258

[45] Date of Patent: Sep. 19, 2000

[54] TIRE PUMP

[76] Inventor: Pai-Chou Chen, No. 130-18, Shih-Lin Tsun, Liu-Ying Hsaing, Tainan Hsien, Taiwan

[21] Appl. No.: 09/238,098

[22] Filed: Jan. 27, 1999

[51] Int. Cl.[7] ..... F04B 17/06

[52] U.S. Cl. ..... 417/231; 417/569; 280/201

[58] Field of Search ..... 417/231, 560, 417/569; 280/201

[56] References Cited

U.S. PATENT DOCUMENTS

| | | | |
|---|---|---|---|
| 510,036 | 12/1893 | Lowth | 417/231 |
| 5,127,804 | 7/1992 | Chappell | 417/231 |
| 5,137,430 | 8/1992 | Alioto | 417/231 |

FOREIGN PATENT DOCUMENTS

| | | | |
|---|---|---|---|
| 59-65583 | 4/1984 | Japan | 417/231 |

*Primary Examiner*—Timothy S. Thorpe
*Assistant Examiner*—Cheryl J. Tyler
*Attorney, Agent, or Firm*—Christensen O'Connor Johnson Kindness PLLC

[57] ABSTRACT

A tire pump, which is adapted to be secured on a bicycle, includes an elongate mounting frame, a cylinder, a piston, a hinge member, and a lever. The mounting frame has first and second ends. The cylinder has a rear end pivotally secured to the second end, and a front end spaced apart from the rear end and disposed to be proximate to the first end. The piston is disposed to reciprocate within the cylinder so as to pump air out of an outlet in the rear end to inflate a bicycle tire. The cylinder further has a piston rod with a fixed end secured to the piston in the cylinder and a coupling end extending axially and outwardly of the front end. The hinge member includes a fixed knuckle member and a movable knuckle member. The fixed knuckle member is disposed on the coupling end. The movable knuckle member has a proximate end hingedly coupled with the fixed knuckle member about a hinging axis, and a distal end disposed to swing towards and away from the rear end so as to move the piston to reciprocate within the cylinder. The lever includes a connecting end pivotally mounted on the first end of the mounting frame, a swingable grip portion, and an intermediate portion disposed to couple with the movable knuckle member so as to transmit swinging movement of the grip portion to the movable knuckle member.

10 Claims, 5 Drawing Sheets

TIRE PUMP

BACKGROUND OF THE INVENTION

1. Field of the Invention

The invention relates to a tire pump, more particularly to a tire pump that is adapted for use on a bicycle, and that is simple in construction and easy to operate.

2. Description of the Related Art

Tire pumps are indispensable to vehicles, particularly two-wheeled ones, such as motorcycles and bicycles. The bicycle, for instance, is a common means of transportation. Any one who has ever ridden a bicycle may have experienced insufficient tire pressure when cycling or using the bicycle to carry a load. As a general rule, in order to avoid damaging the tires of the bicycle in the event of insufficient tire pressure, the cyclist will have to push the bicycle to look for a bicycle or motorcycle shop to inflate the tires. Thus, when there is insufficient pressure in the tires, a tire pump can be used to timely inflate the tires to ensure smooth cycling. In addition, when the tires are punctured and air leaks therefrom, the tire pump can be used to maintain a certain air pressure in the tires temporarily so that the bicycle can be moved safely to a repair shop without damaging the bicycle wheel. Further, as bicycles in general are not equipped with any tire pump, and as it is inconvenient to carry a separate tire pump, it is desirable to have a tire pump that can be installed on the bicycle in an unobtrusive way that does not take up much space.

SUMMARY OF THE INVENTION

Therefore, the main object of the present invention is to provide a tire pump which is adapted for use on a bicycle, which is simple in construction, easy to operate, and compact in size.

Accordingly, a tire pump of the present invention comprises an elongate mounting frame, a cylinder, a piston, a hinge member, and a lever. The elongate mounting frame is adapted to be secured on and extends in a longitudinal direction parallel to one of a crossbar, a down tube and a seat tube of a bicycle. The mounting frame has first and second ends that are spaced apart from each other in the longitudinal direction. The cylinder has a rear end pivotally secured to the second end of the mounting frame and provided with an outlet, and a front end spaced apart from the rear end in a first direction of a first axis and disposed to be proximate to the first end of the mounting frame, with the first axis parallel to the longitudinal direction. The outlet is adapted to be fluidly connected to a tire of the bicycle. The piston is disposed to reciprocate within the cylinder in the first direction so as to pump air out of the outlet for inflating the tire of the bicycle. The cylinder further has a piston rod with a fixed end secured to the piston in the cylinder and a coupling end extending axially and outwardly of the front end of the cylinder. The hinge member includes a fixed knuckle member and a movable knuckle member. The fixed knuckle member is disposed on the coupling end of the piston rod. The movable knuckle member has a proximate end hingedly coupled with the fixed knuckle member about a hinging axis oriented radial to the first axis, and a distal end disposed to swing towards and away from the rear end of the cylinder so as to move the piston to reciprocate within the cylinder. The lever includes a connecting end pivotally mounted on the first end of the mounting frame about the a pivoting axis parallel to the hinging axis, a grip portion disposed to be actuated manually to swing towards and away from the second end of the mounting frame about the pivoting axis, and an intermediate portion disposed between the connecting end and the grip portion and coupled with the distal end of the movable knuckle member so as to transmit swinging movement of the grip portion to the movable knuckle member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
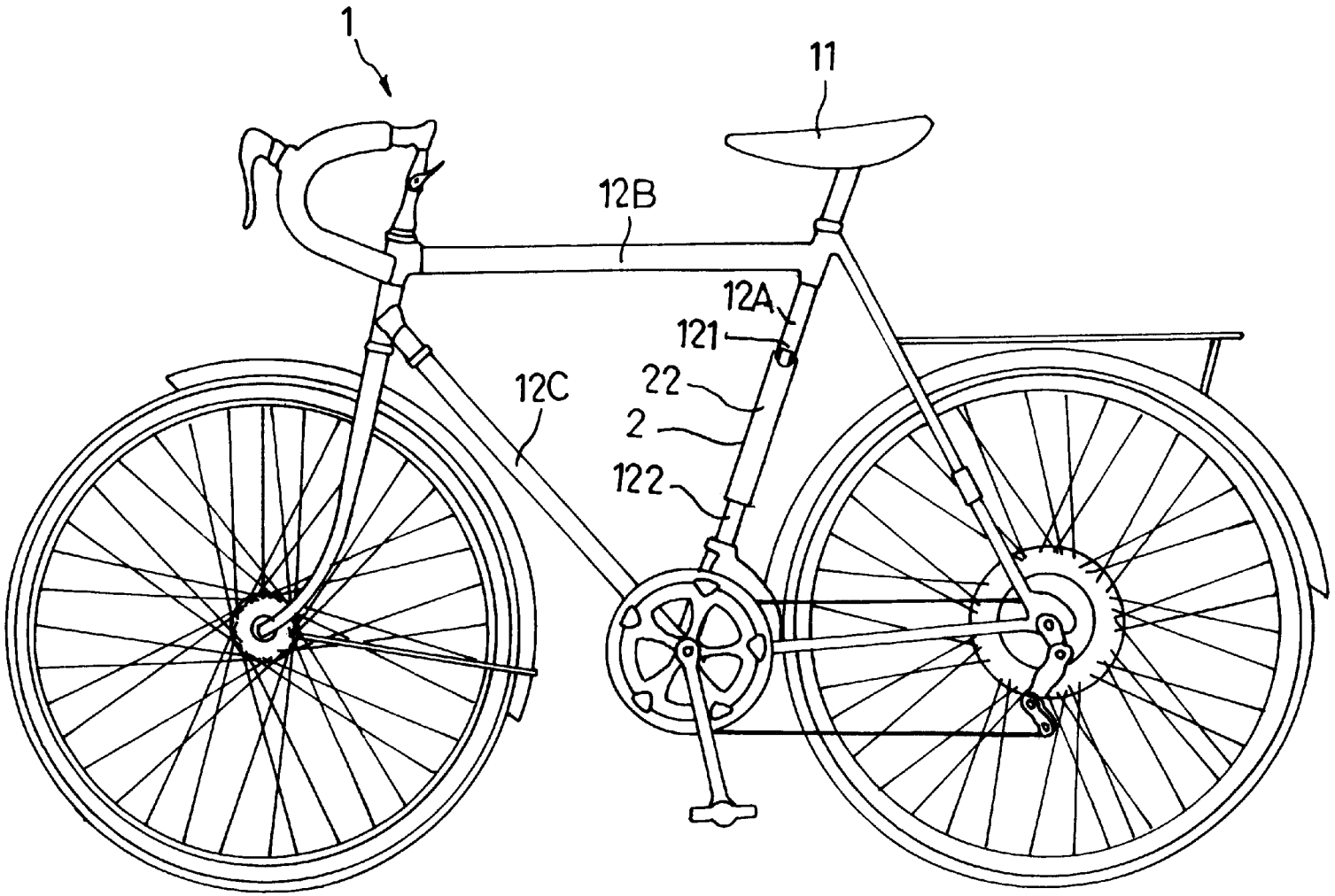
FIG. 1 is a schematic view of a bicycle that incorporates the first preferred embodiment of a tire pump according to the present invention.

Before the present invention is described in greater detail with reference to the preferred embodiments, it should be noted that like elements are denoted by the same reference numerals throughout the disclosure.

Figure 2:
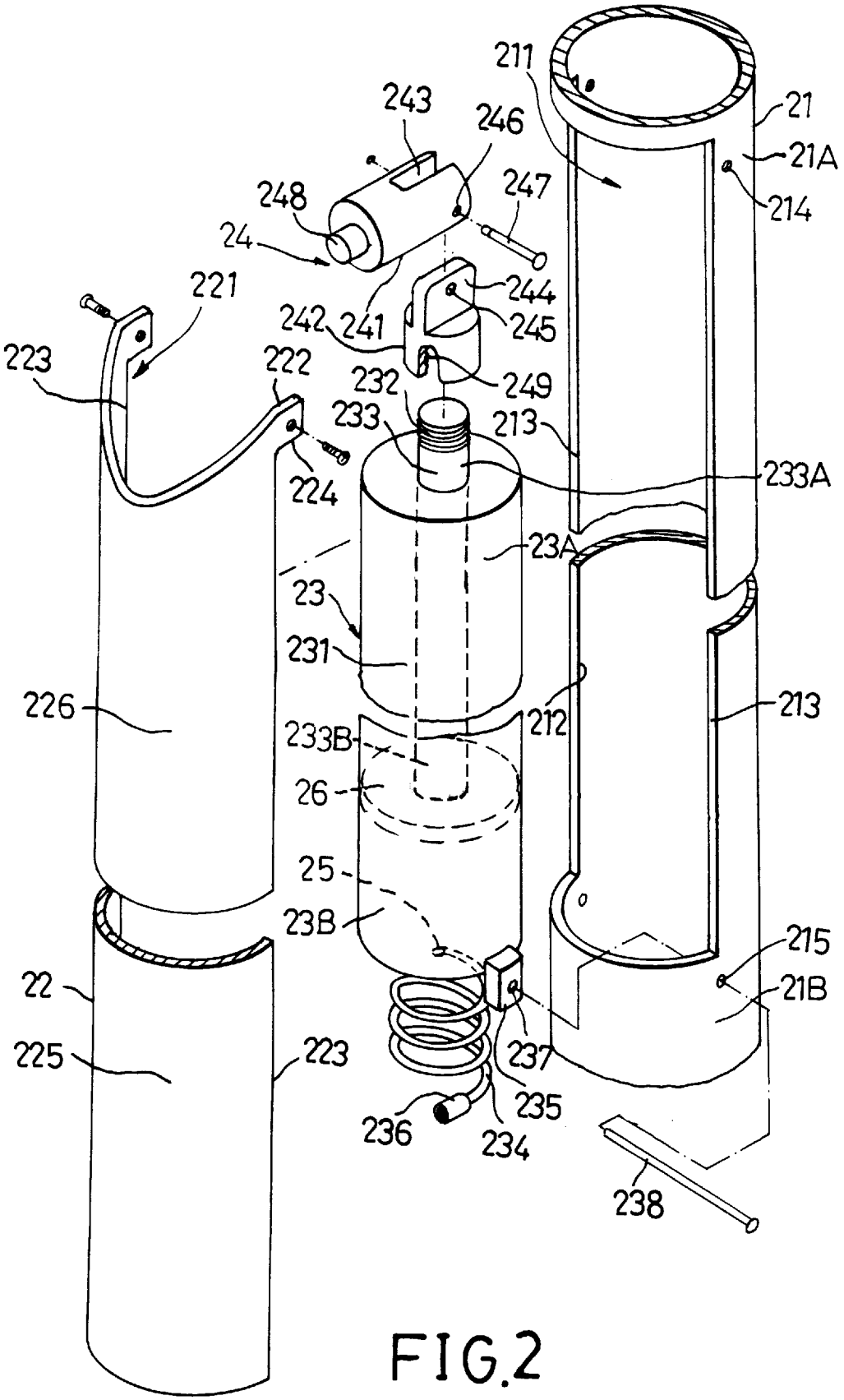
FIG. 2 is a perspective exploded view of the first preferred embodiment.

Referring to FIGS. 1 and 2, the first preferred embodiment of a tire pump 2 of the present invention is adapted to be secured on a bicycle 1 having a seat 11 and a seat tube 12A located below the seat 11. The seat tube 12A is a hollow tubular structure with an upper mounting section 121 and a lower mounting section 122. In the present embodiment, the tire pump 2 is mounted within the upper and lower mounting sections 121, 122, and includes an elongate mounting frame 21, a lever 22, a cylinder 23 received in the mounting frame 21, a hinge member 24, and a piston 26.

The mounting frame 21 is adapted to be secured on and extends in a longitudinal direction parallel to the seat tube 12A of the bicycle 1. The mounting frame 21 has first and second ends 21A, 21B that are spaced apart from each other in the longitudinal direction, and a first semi-circumferential wall that extends from the first end 21A to the second end 21B. The first semi-circumferential wall confines a first receiving space 211 to receive the cylinder 23. The first semi-circumferential wall defines a first opening 212 for exposing the cylinder 23 to the lever 22. The mounting frame 21 further has first abutting edges 213 on opposite lateral edges of the first opening 212. The first end 21A of the mounting frame 21 is provided with a first connecting portion 214 proximate to the first opening 212. In the present embodiment, the first connecting portion 214 is a pair of opposite through holes that pass through the first semi-circumferential wall of the mounting frame 21. The second end 21B of the mounting frame 21 is provided with a second connecting portion 215 in the first semi-circumferential wall. In the present embodiment, the second connecting portion 215 is also a pair of opposite through holes, and the mounting frame 21 is adapted to be formed as a longitudinal segment of the seat tube 12A. As illustrated in FIG. 1, the mounting frame 21 is adapted to be integrated in a middle portion of the seat tube 12A.

The lever 22 is in a form of a second semi-circumferential wall that complements the first semi-circumferential wall such that the assembly of the lever 22 and the mounting frame 21 corresponds in cross section with the seat tube 12A. The lever 22 is disposed to cover the first opening 212 of the mounting frame 21. The second semi-circumferential wall confines a second receiving space 221 with a second opening 222, which corresponds to the first opening 212 of the mounting frame 21. The first receiving space 211 and the second receiving space 221 together confine a receiving chamber for enclosing the cylinder 23. The lever 22 is also formed with two second abutting edges 223 on opposite lateral edges of the second opening 222 to abut against the first abutting edges 213 of the mounting frame 21 such that the mounting frame 21 and the lever 22 can be assembled into a cylindrical structure. Alternatively, the second semi-circumferential wall of the lever 22 may be configured to be larger than a semi-circle so that it can flank opposite lateral sides of the first semi-circumferential wall of the mounting frame 21. The lever 22 further includes a connecting end 224, a grip portion 225, and an intermediate portion 226 disposed between the connecting end 224 and the grip portion 225. The connecting end 224 includes a pair of lugs extending outwardly in the same direction to be pivotally mounted on the first connecting portion 214 at the first end 21A of the mounting frame 21 about a pivoting axis. The grip portion 225 is disposed to be actuated manually to swing towards and away from the second end 21B of the mounting frame 21 about the pivoting axis.

The cylinder 23 has a rear end 23B and a front end 23A. The rear end 23B is provided with an outlet 25 and is pivotally secured to the second connecting portion 215 at the second end 21B of the mounting frame 21. The front end 23A is spaced apart from the rear end 23B in a first direction of a first axis, and is disposed to be proximate to the first end 21A with the first axis parallel to the longitudinal direction of the mounting frame 21. The cylinder 23 further includes a cylinder body 231 for accommodating therein the piston 26, a piston rod 233 that extends axially and upwardly from the front end 23A, a coupling hose 234 connected to the rear end 23B for fluid connection between the outlet 25 and a tire 13 of the bicycle 1 (see FIG. 3), and a connecting plate 235 disposed at the rear end 23B. The piston 26 is disposed to reciprocate within the cylinder 23 in the first direction of the first axis so as to pump air out of the outlet 25 to inflate the tire 13 of the bicycle 1. The piston rod 233 has a fixed end 233B secured to the piston 26, and a coupling end 233A extending axially and outwardly of the front end 23A of the cylinder 23. The coupling end 233A is provided with external threads 232. The coupling hose 234 has a free end that is provided with a connector 236 for coupling with an inflating valve 131 on the tire 13 of the bicycle 1 (see FIG. 3). The connecting plate 235 is formed with a connecting hole 237 that corresponds to the second connecting portion 215 of the mounting frame 21. A connecting element 238 passes through the connecting hole 237 and the second connecting portion 215 to mount pivotally the cylinder 23 within the mounting frame 21.

The hinge member 24 includes a movable knuckle member 241 and a fixed knuckle member 242. The movable knuckle member 241 has a proximate end 243 hingedly coupled with the fixed knuckle member 242 about a hinging axis oriented radial to the first axis of the cylinder 23, and a distal end 248 disposed to swing towards and away from the rear end 23B. The proximate end 243 is provided with opposite pivot holes 246. The distal end 248 is soldered to an inner side of the second semi-circumferential wall of the lever 22. The fixed knuckle member 242 includes an upper end forming a projecting portion 244 and a lower end forming a threaded mounting hole 249. The projecting portion 244 is formed with a pivot hole 245. A hinge pin 247 is used to define the hinging axis to hingedly couple the proximate end 243 to the projecting portion 244 of the fixed knuckle member 242, whereby the fixed knuckle member 242 can swing pivotally relative to the movable knuckle member 241 using the hinge pin 247 as a fulcrum. The threaded mounting hole 249 of the fixed knuckle member 242 is provided for threaded engagement with the coupling end 233A of the piston rod 233 to thereby couple the lever 22 to the piston rod 233.

Figure 3:
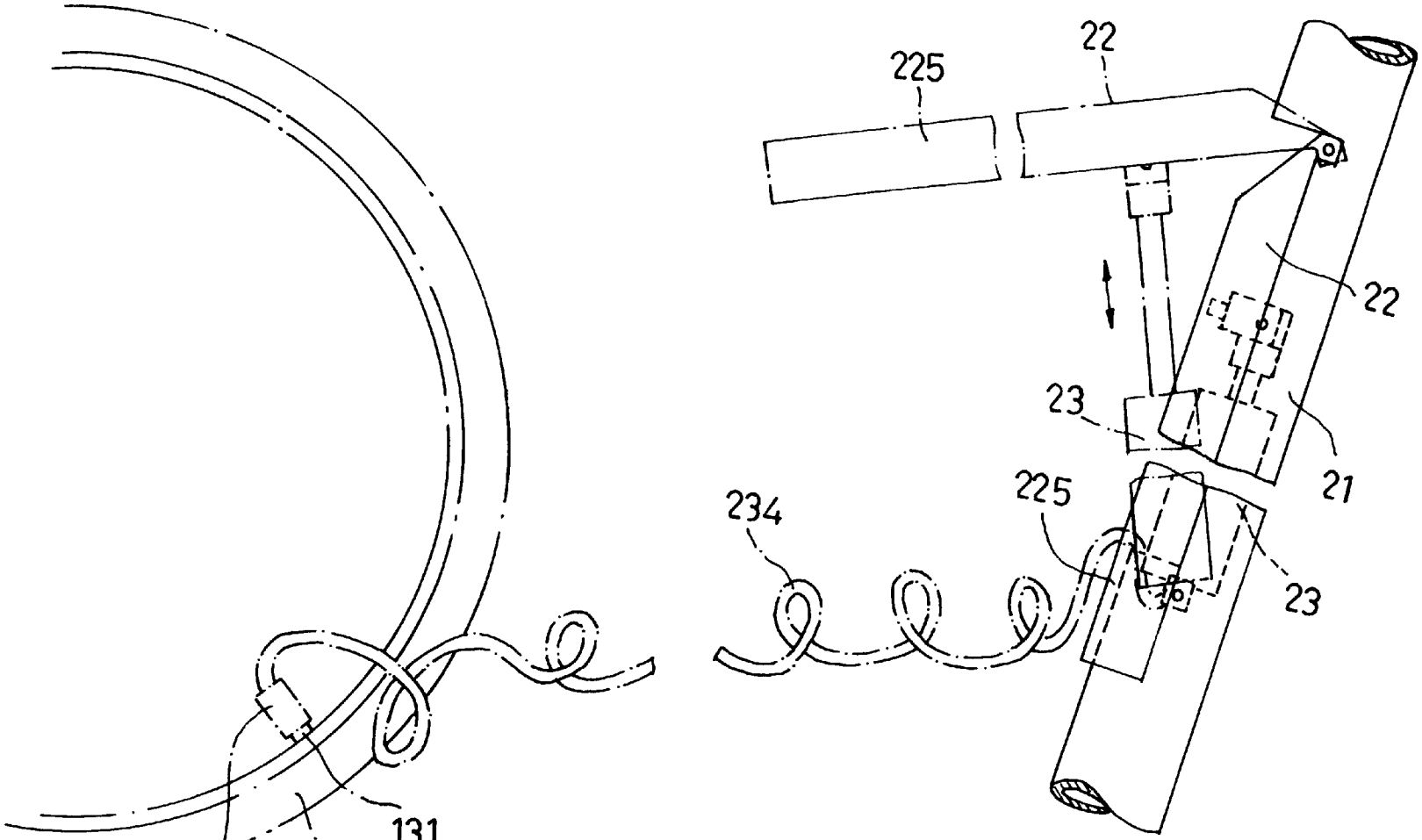
FIG. 3 is a schematic view illustrating the first preferred embodiment in a state of use.

In use, with reference to FIG. 3, the coupling hose 234 is pulled out of the receiving chamber, and the connector 236 is connected to the inflating valve 131 on the tire 13. The grip portion 225 of the lever 22 is held in one hand and is swung towards and away from the second end 21B of the mounting frame 21 about the pivoting axis between the lever 22 and the mounting frame 21. During the swinging operation, by virtue of the hinge member 24, the lever 22 can actuate the piston rod 233 of the cylinder 23, which causes the piston 26 inside the cylinder 23 to reciprocate in the first direction so as to force air to flow through the coupling hose 234 and into the tire 13

When not in use, the lever 22 is turned hingedly to rest against the mounting frame 21 so as to return to the state shown in FIG. 1. It can be seen from FIG. 1 that, after assembly, the tire pump 2 of the present invention appears to be a segment of the seat tube 12A so that the tire pump 2 is inconspicuous on the bicycle 1. It can therefore be appreciated that the design of the present invention is ingenious and practical. It is noteworthy that the tire pump 2 of the present invention can not only be mounted on the bicycle 1 in a concealed manner, the mounting frame 21 can also be formed with the seat tube 12A of the bicycle 1 integrally. In this arrangement, the seat tube 12A is provided with a recess for receiving the lever 22, which may be provided pivotally on the seat tube 12A and stored inside the recess when not in use.

It should be noted that, instead of the seat tube 12A, the tire pump 2 can be adapted for securing on a crossbar 12B or a down tube 12C of the bicycle 1.

Figure 4:
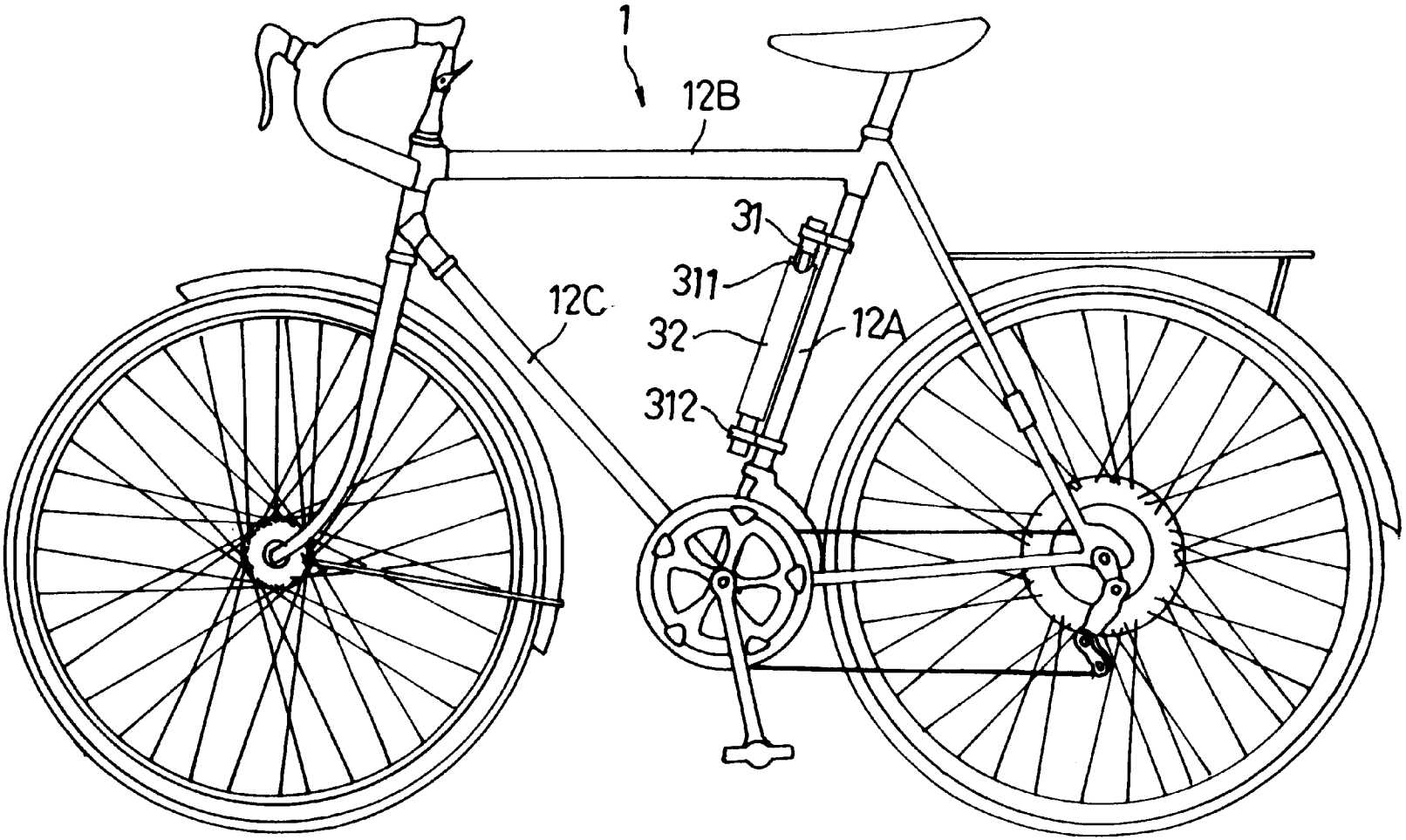
FIG. 4 is a schematic view of a bicycle that incorporates the second preferred embodiment of the tire pump according to the present invention.

Reference is made to FIG. 4, which is a schematic view of a bicycle that incorporates the second preferred embodiment of the tire pump according to the present invention. The tire pump of the present embodiment is substantially the same as the embodiment described above, and comprises an elongate mounting frame 31, a lever 32, a cylinder (not shown) accommodated within the mounting frame 31, and a hinge member (not shown) disposed hingedly between the cylinder and the lever 32. As the cylinder and the hinge member in the present invention are the same as those in the previous embodiment, a detailed description of the same is omitted herein for the sake of brevity. The present embodiment differs from the previous embodiment in that the mounting frame 31 has a circumferential wall that is provided with a longitudinally oriented groove 311. The lever 32 is sized and shaped to match the groove 311, and has one end mounted pivotally on the mounting frame 31. In use, two connecting members 312 are utilized to assemble the mounting frame 31 together with the lever 32 on the seat tube 12A of the bicycle 1.

Figure 5:
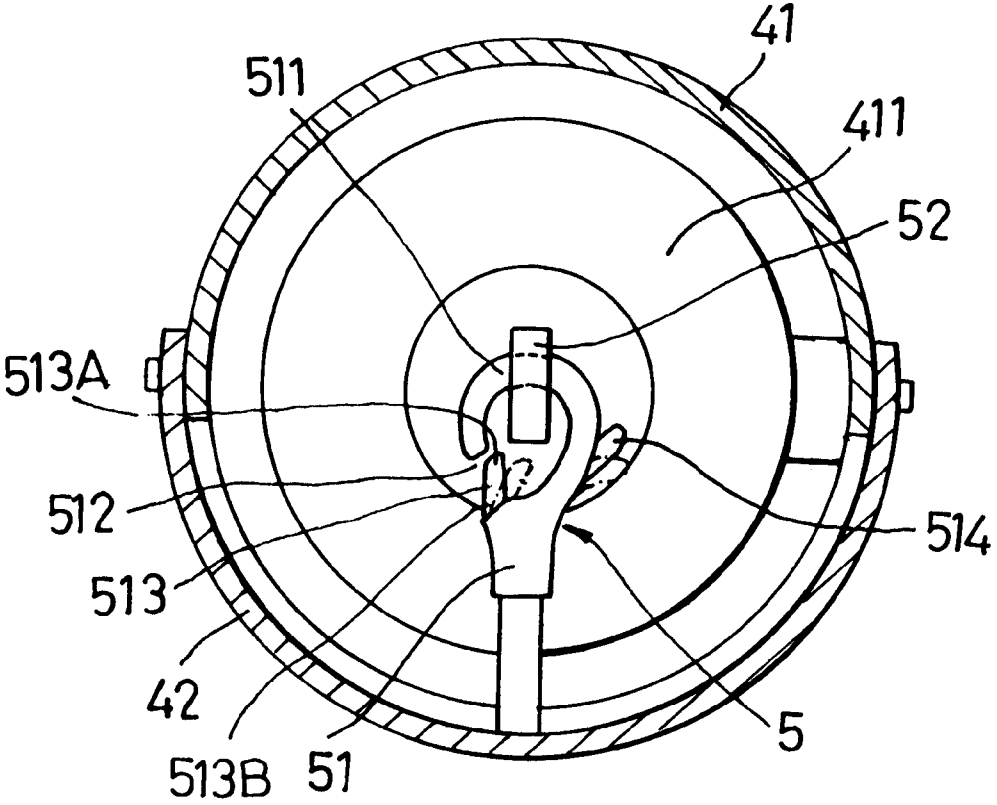
FIG. 5 is an assembled sectional view of a third preferred embodiment of the tire pump according to the present invention.

Reference is made to FIG. 5, which is a schematic view illustrating the third preferred embodiment of the tire pump of the present invention in use. The third preferred embodiment comprises an elongate mounting frame 41, a lever 42, a cylinder 411 disposed inside the mounting frame 41, and a hinge member for connecting hingedly the cylinder 411 and the lever 42. As the structural relationship among the mounting frame 41, the lever 42, and the cylinder 411 are the same as those in the first and second preferred embodiments, a more detailed description thereof is omitted herein for the sake of brevity. The main difference between the present embodiment and the previous embodiments resides in that the hinge pin 247 and the proximate end 243 of the movable knuckle member 241 of the first preferred embodiment are integrally formed into a hook ring 5. The hook ring 5 defines a plane to which the first axis of the cylinder 411 is normal, and includes a first portion 51 adjacent to the intermediate portion 226 of the lever 22, and a second portion 511 that is diametrically opposite to the first portion 51 relative to the first axis. The hook ring 5 is disposed to be coupled hingedly with the fixed knuckle member 52 around the hinging axis. The hook ring 5 is interrupted near the first portion 51 so as to form an access opening 512 for facilitating coupling of the second portion 511 with the fixed knuckle member 52. The hook ring 5 further includes a jaw member 513 that has a third end 513B mounted pivotally at the first portion 51 about a second axis parallel to the first axis, and a free end 513A extending from the third end 513B. The jaw member 513 is swingable between a closed position where the access opening 512 is blocked by the free end 513A, and an opened position where the free end 513A is cleared out of the access opening 512. A finger piece 514 is disposed in the first portion 51 and is associated operably with the jaw member 513 so as to shift the free end 513A between the opened position and the closed position.

From the foregoing, it can be appreciated that the tire pump of the present invention can be coupled integrally to the bicycle as a whole, and that the elongate mounting frame and the lever are connected hingedly and confine therebetween a receiving chamber for enclosing the cylinder. By swinging the lever relative to the mounting frame, the piston rod of the cylinder can be actuated to cause the piston within the cylinder to reciprocate therein for tire inflation. When not in use, the tire pump of the present invention appears to be an integral part of the bicycle. To use the tire pump of the present invention, it is only necessary to pull out the coupling hose and connect it to a tire to be inflated, and to swing the lever with respect to the mounting frame to achieve tire inflation. The tire pump of the present invention is not only easy to operate but also compact in size.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A tire pump adapted to be secured on one of a crossbar, a down tube and a seat tube of a bicycle, comprising:

an elongated mounting frame adapted to be secured to and extending in a longitudinal direction parallel to at least a portion of said one of the crossbar, the down tube and the seat tube, said mounting frame having first and second ends that are spaced apart from each other in said longitudinal direction;

a cylinder having a rear end provided with an outlet and pivotally secured to said second end of said mounting frame, and a front end which is spaced apart from said rear end in a first direction of a first axis and disposed to be proximate to said first end of said mounting frame and with said axis parallel to said longitudinal direction, said outlet being adapted to be fluidly connected to a tire of the bicycle;

a piston disposed to reciprocate within said cylinder in said first direction so as to pump air out of said outlet for inflating the tire of the bicycle;

a piston rod having a fixed end secured to said piston in said cylinder and a coupling end extending axially and outwardly of said front end of said cylinder;

a fixed knuckle member disposed on said coupling end of said piston rod;

a movable knuckle member having a proximate end hingedly coupled with said fixed knuckle member about a hinging axis oriented radial to said first axis, and a distal end disposed to swing towards and away from said rear end of said cylinder so as to move said piston to reciprocate within said cylinder; and a lever including a connecting end pivotally mounted on said first end of said mounting frame about a pivoting axis parallel to said hinging axis, a grip portion disposed to be actuated manually to swing towards and away from said second end of said mounting frame about said pivoting axis, and an intermediate portion disposed between said connecting end and said grip portion and coupled with said distal end of said movable knuckle member so as to transmit swinging movement of said grip portion to said movable knuckle member.

2. A tire pump according to claim 1, wherein said mounting frame is additionally formed as a longitudinal segment of said one of the crossbar, the down tube and the seat tube.

3. A tire pump according to claim 2, wherein said mounting frame is formed as a middle portion of the seat tube.

4. A tire pump according to claim 3, wherein said mounting frame includes a first semi-circumferential wall extending from said first end to said second end, said first semi-circumferential wall defining an opening to expose said cylinder to said lever, and wherein said lever is in a form of a second semi-circumferential wall disposed to cover said opening.

5. A tire pump according to claim 4, wherein said second semi-circumferential wall complements said first semi-circumferential wall such that assembly of said lever and said mounting frame corresponds in cross section with the seat tube.

6. A tire pump according to claim 1, wherein said fixed knuckle member is mounted threadedly on said coupling end of said piston rod.

7. A tire pump according to claim 1, further comprising a hinge pin disposed to define said hinging axis and to couple said proximate end of said movable knuckle member to said fixed knuckle member.

8. A tire pump according to claim 7, wherein said hinge pin and said proximate end of said movable knuckle member are integrally formed into a hook ring which defines a plane to which said first axis is normal, and which includes a first portion adjacent to said intermediate portion of said lever, and a second portion which is diametrically opposite to said first portion relative to said first axis, said second portion being hingedly coupled with said fixed knuckle member around said hinging axis.

9. A tire pump according to claim 8, wherein said hook ring is interrupted near said first portion so as to form an access opening for facilitating coupling of said second portion with said fixed knuckle member.

10. A tire pump according to claim 9, further comprising:

a jaw member having a third end mounted pivotally at said first portion about a second axis parallel to said first axis and a free end extending from said third end, said jaw member being swingable between a closed position where said access opening is blocked by said free end, and an opened position where said free end is cleared out of said access opening; and a finger piece disposed in said first portion and associated operably with said jaw member so as to shift said free end between said opened position and said closed position.

* * * * *

UNITED STATES PATENT AND TRADEMARK OFFICE

CERTIFICATE OF CORRECTION

PATENT NO. : 6,120,258

DATED : September 19, 2000

INVENTOR(S) : P.-C. Chen

It is certified that error appears in the above-identified patent and that said Letters Patent is hereby corrected as shown below:

| COLUMN | LINE | |
|---|---|---|
| [54] Pg. 1, col. 1 | Title | "TIRE PUMP" should read --TIRE PUMP MOUNTING MEANS SECURED TO A FRAME ELEMENT OF A BICYCLE-- |
| [56] Pg. 1, col. 1 | Refs. Cited (Foreign Pats., Item 1) | "59-65583" should read --59-65583A-- |
| 1 | 1 | "TIRE PUMP" should read --TIRE PUMP MOUNTING MEANS SECURED TO A FRAME ELEMENT OF A BICYCLE-- |

Signed and Sealed this

First Day of May, 2001

*Attest:*

Nicholas P. Godici

NICHOLAS P. GODICI

*Attesting Officer*

*Acting Director of the United States Patent and Trademark Office*